US005924599A

United States Patent [19]

Brown

[11] Patent Number: 5,924,599

[45] Date of Patent: Jul. 20, 1999

[54] DISPENSING SYSTEM WITH UNIQUE CONTAINER ATTACHMENT

[75] Inventor: Daniel P. Brown, Palos Park, Ill.

[73] Assignee: Flexible Products Company, Marietta, Ga.

[21] Appl. No.: 09/008,187

[22] Filed: Jan. 16, 1998

[51] Int. Cl.[6] ..... B67D 5/60

[52] U.S. Cl. ..... 222/135; 222/145.1; 222/402.15; 222/325; 239/304; 239/414

[58] Field of Search ..... 222/135–137, 222/145.1, 145.5, 145.6, 325, 402.15; 239/304, 306, 303, 414

[56] References Cited

U.S. PATENT DOCUMENTS

| | | | |
|---|---|---|---|
| 2,068,205 | 1/1937 | Steckel, Jr. et al. . | |
| 3,178,157 | 4/1965 | Cole, III . | |
| 3,303,970 | 2/1967 | Breslau et al. | 222/134 |
| 3,416,709 | 12/1968 | Shultz et al. | 222/94 |
| 3,559,890 | 2/1971 | Brooks et al. | 239/304 |
| 3,575,319 | 4/1971 | Safianoff | 222/135 |
| 3,613,956 | 10/1971 | McCulloch | 222/136 |
| 3,633,795 | 1/1972 | Brooks | 222/135 X |
| 3,635,372 | 1/1972 | Van Dyck et al. | 222/135 X |
| 4,496,081 | 1/1985 | Farrey | 222/135 |
| 4,549,676 | 10/1985 | Gerich . | |
| 4,674,658 | 6/1987 | Van Brocklin | 222/137 |
| 4,773,562 | 9/1988 | Gueret | 239/304 X |
| 4,826,048 | 5/1989 | Skorka et al. | 239/304 X |
| 4,880,143 | 11/1989 | Murray et al. | 222/135 |
| 4,955,544 | 9/1990 | Kopp | 239/304 |
| 4,958,750 | 9/1990 | Palmert et al. | 222/135 |
| 5,092,492 | 3/1992 | Centea | 222/137 |
| 5,332,157 | 7/1994 | Proctor | 239/304 |
| 5,344,051 | 9/1994 | Brown | 222/135 |
| 5,425,404 | 6/1995 | Dyer | 222/325 X |
| 5,568,883 | 10/1996 | Cataneo et al. | 222/136 |

FOREIGN PATENT DOCUMENTS

| | | |
|---|---|---|
| 365151 | 6/1948 | Japan . |
| 313840 | 7/1952 | Japan . |
| 30246 | 9/1972 | Japan . |
| 127466 | 10/1974 | Japan . |
| 15613 | 5/1975 | Japan . |
| 113622 | 6/1981 | Japan . |
| 197754 | 3/1982 | Japan . |
| 1137258 | 2/1983 | Japan . |
| 59-723 | 5/1984 | Japan . |
| 1613840 | 3/1985 | Japan . |
| 1298638 | 1/1986 | Japan . |
| 1114859 | 5/1989 | Japan . |
| 1124088 | 5/1989 | Japan . |
| 444979 | 2/1992 | Japan . |

*Primary Examiner*—Kevin P. Shaver
*Attorney, Agent, or Firm*—Vedder Price Kaufman & Kammholz

[57] ABSTRACT

A dispenser for holding two or more cans of material adapted to create a froth, a caulking or like product. The holders of the cans contain separate attachments for engaging the containers and holding them in a position of use. This insures that the cans cannot be inserted the wrong way into the dispenser. In a preferred form, the dispenser includes two can holders, a manifold, a dispensing gun and a receiver for a disposable nozzle. The two can holder fittings are respectively male/female, and in another embodiment, left hand/right hand threads.

18 Claims, 6 Drawing Sheets

DISPENSING SYSTEM WITH UNIQUE CONTAINER ATTACHMENT

BACKGROUND OF THE INVENTION

The present invention relates generally to dispensers, for foam, for caulking and the like, and more particularly, to a plural-component dispensing gun with a disposable nozzle that is suitable to be used in a variety of applications. The present invention incorporates a new can attachment and activation method which includes male and female threads respectively on the can holders as well as the containers of the invention. Also, the present invention is uniquely adaptable to different forms of dispensers using the same or similar components. While more than two components can be supplied using the system of the invention, the preferred embodiments will be illustrated as having two components, and having a dispenser, preferably in the form of a gun.

According to the invention, two cans are positioned for use in a valve-down position for subsequent dispensing by activating a trigger and discharging the ingredients through a dispenser/mixer, preferably of throwaway nozzle form, which then directs onto the work area the foam resulting from mixing of the ingredients of the two containers.

In one embodiment, the can holder/activator, gun and the manifold are assembled together in a single piece, with the nozzle being removable therefrom and the cans being reloadable once discharged for continued usage of the system. In addition, the two cans are removable from the dispensing gun allowing for insertion of fresh cans. Because the A component and B component (or the isocyanate component and resin component in the case of a urethane foam), are constructed and arranged so that it is impossible to insert the resin can into the isocyanate side and vice versa, the possibility of crossover of the compounds upon reuse of the system is eliminated.

The reason for coding or arranging the cans so that "wrongful" insertion cannot be done is that, in the case of a used or spent can taken from either side, the components upstream of the valve seat area will contain a given material. When replacing one or both components with another container, if the "wrong" can is used, there would be a reaction downstream of the can valve, causing a reaction with possible permanent clogging of the assembly.

In the event the gun were discharged immediately, using the "wrong" container, at least an off-ratio mix would be supplied for at least a time. If the gun were not used almost immediately, the reaction products of the foam would set up, and within 30 seconds or so, render the gun useless.

Because the dispensing system is suitable for a number of uses by reason of the kit's design, (a plurality of disposable nozzles is included) the probability of replacing the cans is relatively great and this represents a new feature in the art.

In the ideal practice of the invention, the can and the dispenser are constructed and arranged so that only the right kind of can can be inserted into the can holder. Thus, there is no possibility of having a mix-up in the can by an inexperienced operator, with the result that the gun is rendered valueless. In another embodiment, the two can adapters could be supplied with left- and right-hand threads, which would render using the "wrong" one difficult but not impossible.

Accordingly, it is an object of the present invention to provide an improved dispenser for materials such as thermosetting foams.

It is another object of the invention to provide a gun with a removable nozzle which includes a manifold feeding feature.

Yet another object of the invention is to provide a system having a pair of can receiving structures, with the receiving structure differing from each other and adapted to receive cans with different attachment structures or mechanisms. The structures are preferably in the form of adapters.

Still another object of the invention is to provide a structure for holding the cans, of which one adapter or receiver contains male threads and the other adapter contains female threads.

A further object of the invention is to provide a container holder which receives first and second containers, each of which is actuated by screwing each one into place in the adapter by a different mechanism, and thereafter actuating the dispenser by pulling a trigger or the like.

A still further object of the invention is to provide a can holder with a pair of adapters with hose barb fittings, each of the adapters being affixed to a hose and each being insertable into a counterpart formation on the can holder, whereby the adapters receive each of the different valve configurations and are secured relative to the can holder by screwing the cans into the adapters.

An additional object of the invention is to provide a dispenser system containing a pair of can adapters received within a single holder unit, with each adapter receiving a different form of can, and with flexible hoses permitting the nozzle and trigger assembly to be remotely located relative to the housing.

Another object of the invention is to provide a can positioning and carrying system that allows for the use of various size containers through the same system, depending on the application. In one embodiment, the same size cans are used where the chemistry requires equal ratio components. But without any changes, the system of the current invention can accept cans of different sizes (lengths) to allow for materials of dissimilar ratios to be used. A unique feature of the system allows the operator to reuse the can holder/dispenser assembly over and over by simply reloading the system with fresh cans of material, and using fresh mixing materials.

Still another object of the invention is to provide a system that can work to process foam or other end use chemical without a dispensing gun. In this embodiment, the supply hoses are attached directly to a nozzle. This embodiment utilizes a low cost pinch valve to control the material flow to the nozzle. This version is suited to applications requiring the lowest cost system.

The manner in which the foregoing and other objects and advantages of the invention are achieved in practice includes providing a can holder for two containers, a dispensing device including a throwaway nozzle, and is characterized by having the adapters include one female thread and one male thread, preferably of different sizes, whereby the containers of material fed to them cannot be accidentally interchanged.

The invention also achieves it objects, in another embodiment, by featuring adapters with respectively male and female threads adapted to retain the containers within the receiver and a mixing and dispensing nozzle situated some distance away and connected by flexible hoses to the cans. The containers may in some cases be equipped with right- and left-hand threads instead of male-female or different size threads to prevent use of an otherwise identical container in the "wrong" place.

The manner in which these objects and advantages are achieved in practice will become more clearly apparent when taken in connection with a detailed description of the preferred embodiments of the invention set forth by way of example and shown in the accompanying drawings, in which like reference numbers indicate the corresponding parts throughout.

DESCRIPTION OF THE PREFERRED EMBODIMENTS OF THE INVENTION

While the invention may take a number of forms, the first embodiment will be described wherein the cans are retained within a can holder, wherein the can holder includes a pair of adapters with transitions to a manifold, and where the manifold is attached to the adapters by a press-on, non-rotating attachment. A second embodiment includes a relatively remote dispenser connected to the adapters with hoses, with the same type of can holder and adapters, placed in a different position.

Figure 1:
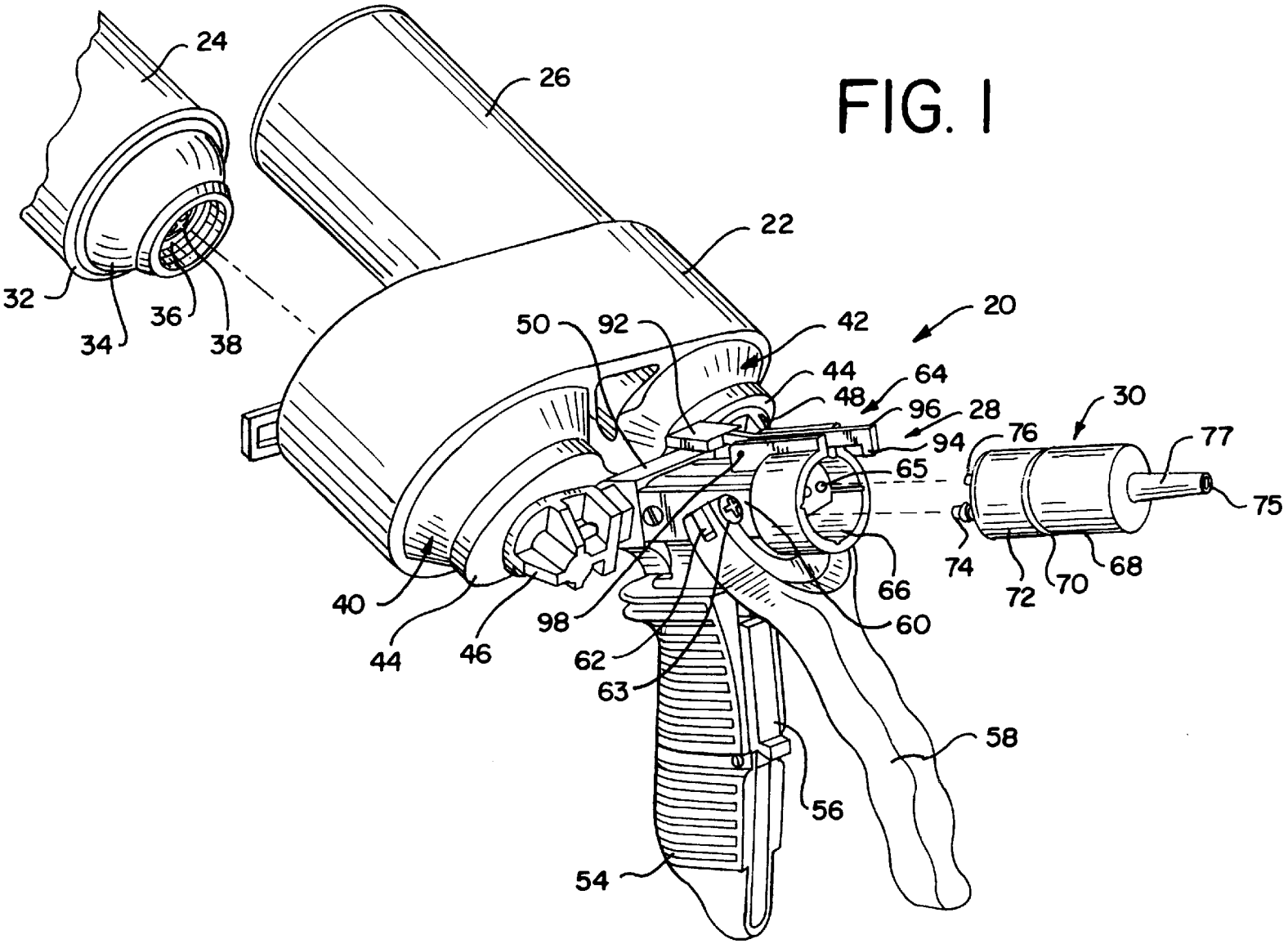
FIG. 1 is a perspective view of the can receiver and gun of the invention, showing a nozzle and one can in an exploded relation thereto and the trigger in the off position.
Figure 2:
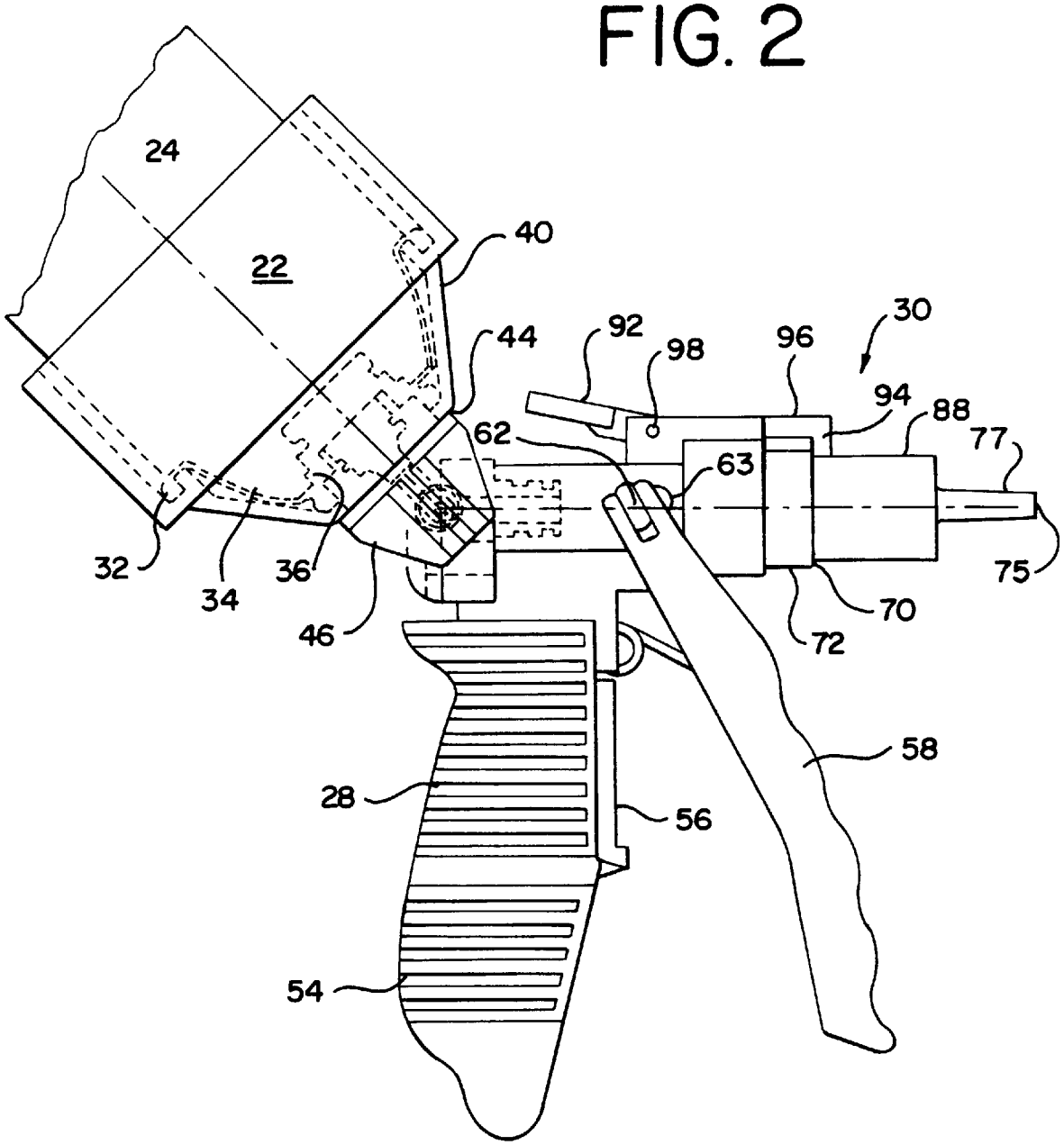
FIG. 2 is a side elevational view, with portions shown in phantom, showing the cans in position of use within the foam dispenser of the invention.
Figure 3:
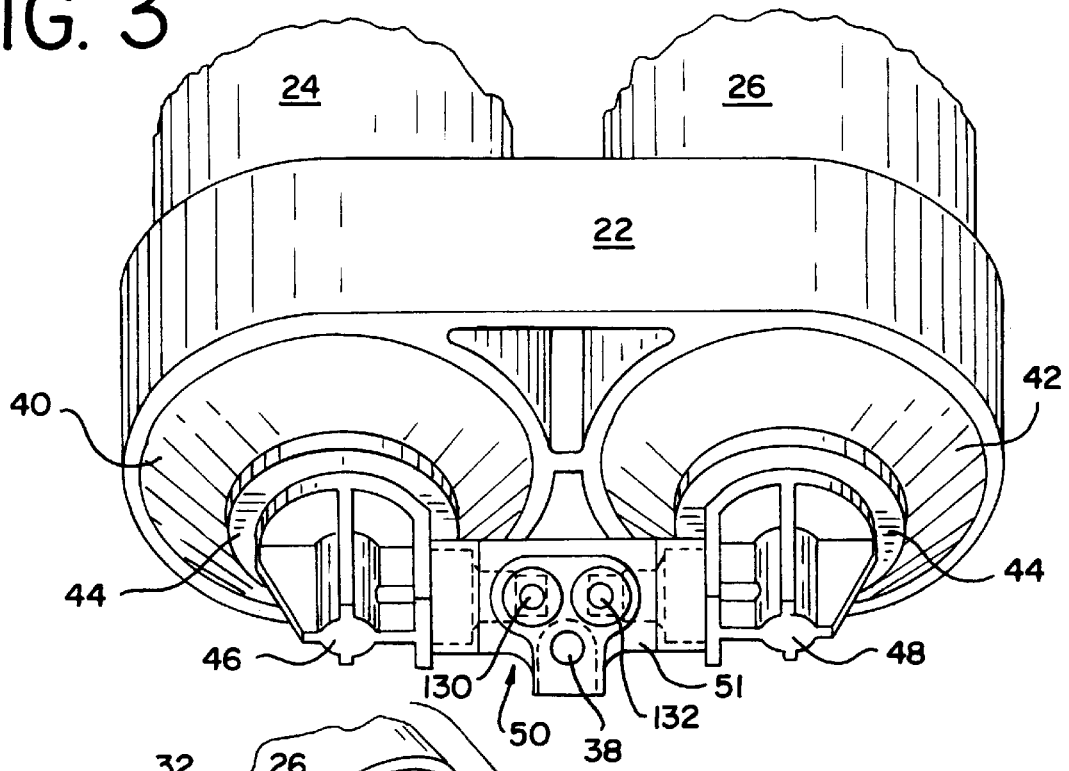
FIG. 3 is an enlarged fragmentary perspective view of the can carrier and showing the adapters and the manifold in the absence of any type dispenser.
Figure 4:
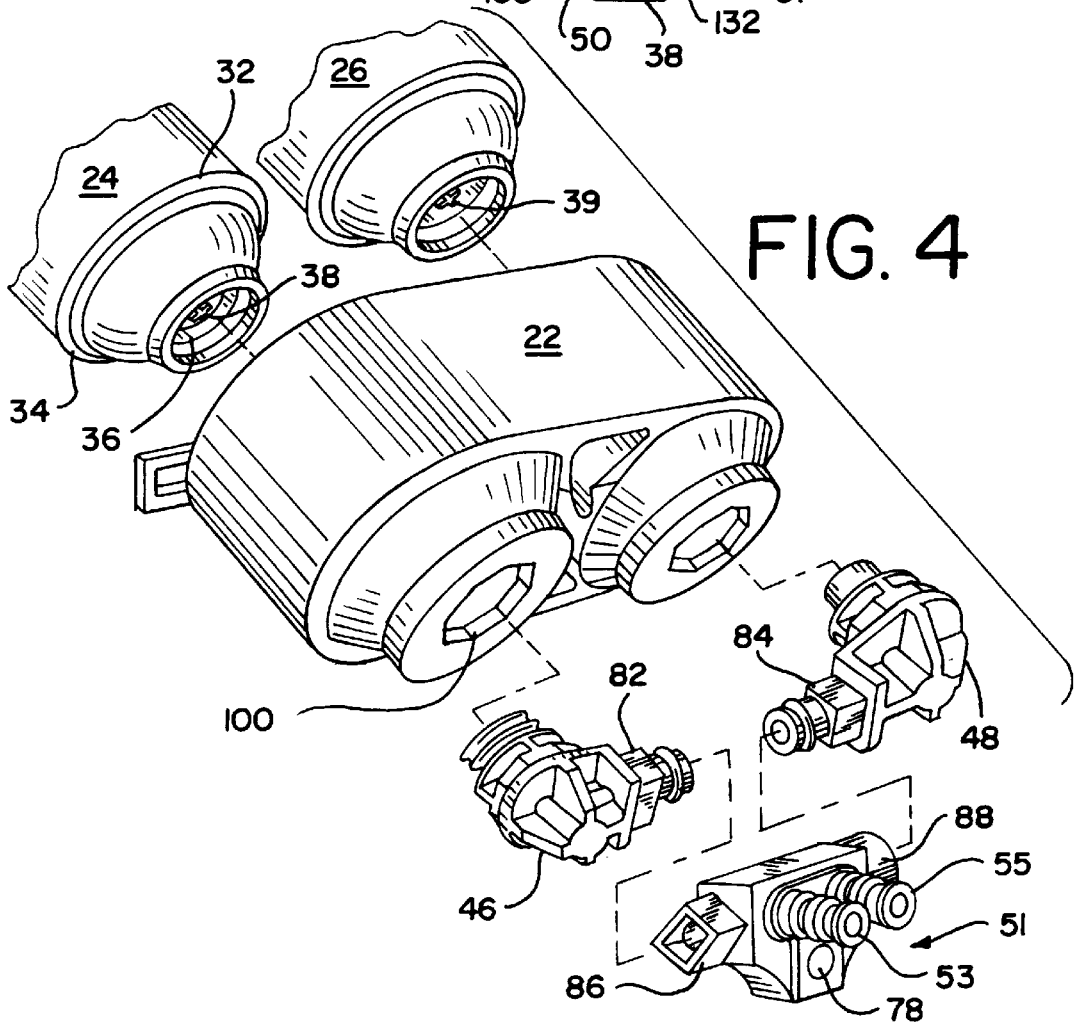
FIG. 4 is an exploded perspective view showing one version of the components of the invention, including the holders for containers such as cans, the adapters, the center section of the manifold, and portions of the containers, just prior to assuming their position of use.

In FIG. 1, a dispensing assembly generally designated 20 is shown to generally comprise a can holder 22, a pair of cans generally designated 24, 26, a dispenser generally designated 28 and a removable nozzle generally designated 30. Each can 24, 26 includes an upper chime 32, a dome 34, a valve cup/thread assembly 36, and a dispensing valve 38. The can holder 22 includes a pair of crowns generally designated 40, 42, each containing a flat surface 44 for receiving an adapter 46, 48 forming one end of a manifold assembly 50. Referring now to FIG. 4, the manifold assembly 50 includes a center section generally designated 51 press-fit between the adapters 46, 48 to form the manifold assembly 50 having twin outlets 53, 55 leading to the inlet of the gun 28.

This dispenser version is in the form of a gun 28 that includes several other components. These include, and referring again to FIG. 1, a handle 54, a trigger safety 56, a trigger 58, a valve body 60, an ejection-retention mechanism generally designated 64, and a nozzle-receiving collar 66. The nozzle generally designated 30 includes a main body portion 68, a shoulder 70 formed where an enlarged diameter rear section 72 meets the main body portion 68 and a pair of nipples 74, 76 containing internal inlet passages. The nozzle includes a dispensing opening 75 in the end of a reduced diameter section 77.

Referring again to the manifold assembly 50, and to FIG. 4, this unit includes a left can adapter 46, a right hand can adapter 48 and left- and right-hand square bosses 82, 84 adapted to mate with female skirts 86, 88 formed in the center section 51 of the manifold 50. The manifold assembly 50 including the adapters 46, 48 attaches to the gun generally designated 28 on the one side and to the cans 24, 26 on the other. A fastener (not shown) may extend through the opening 78 to secure this attachment. In normal use, the dispenser and manifold assembly remain together indefinitely.

Referring to FIG. 1, the gun 28 includes a spool valve (not shown) of the type illustrated, for example, in U.S. Pat. No. 4,676,437. It includes, in addition to the operating ear 62 engaged by the trigger, a retaining screw 63. The spool passes through the body 60 of the gun and controls flow through between the manifold 50, the spool valve and the gun outlet passages 65 adapted to mate with the nipples 74, 76. The nozzle is removably held in place and released by a mechanism 64 which includes a thumb button 92, a claw 94, a shank 96 and a pivot point 98 about which the shank pivots.

Figure 5:
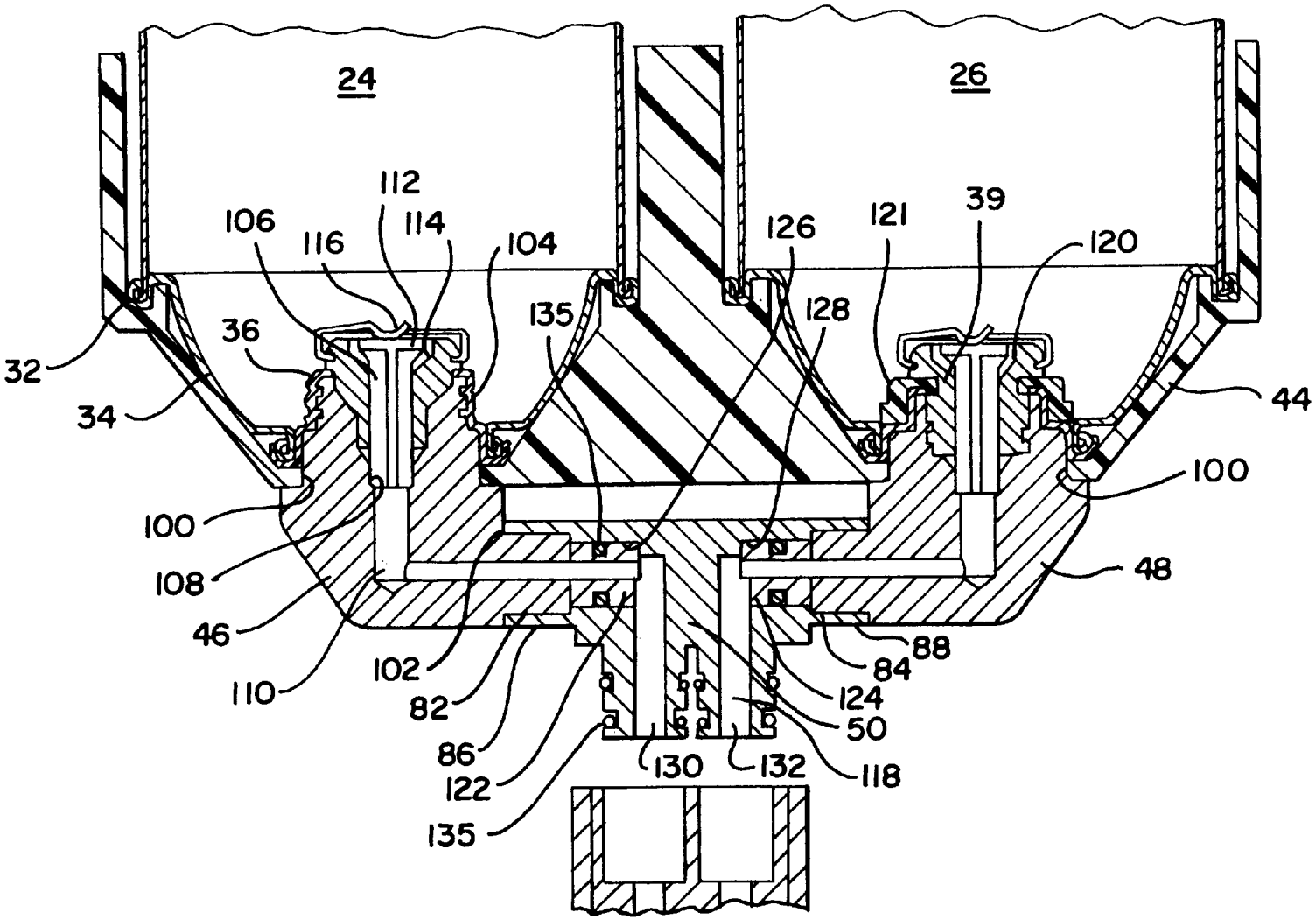
FIG. 5 is a vertical sectional view, showing the manifold version of the invention and showing the cans in place with their valves being actuated by the adapters.

Referring now to FIG. 5, the construction of the adapters 46, 48 and the can valves 38 may be seen. In FIG. 5, the cans are shown inserted fully within the adapters 46, 48. Each adapter 46, 48 is secured to the holder 22 by means which include an octagonal opening 100 in the crown 44 of the can holder 22. The adapter 46 includes a counterpart eight-sided formation 102 corresponding to the eight-sided opening in the crown 44. Other non-circular openings and formations may be used.

The exterior threads 104 on one version the adapter mate with the threads 36 on the valve cup. In use, as the can 24 is fully screwed into the adapter, the stem portion 106 of the valve is depressed by engagement with a shoulder 108 in the passage 110 in the adapter 46. This engagement opens the valve by moving the head portion 112 of the valve off the valve seat 114 against the action of the spring 116.

A counterpart situation exists in respect to the right-hand adapter 48, except that the adapter is internally threaded, and the adapter threads 120 mates with external threads 121 on the valve body 39 to complete the engagement.

Thus, when the cans are inserted fully in place within the holder, they are held by the adapters engaging the cans, and the passages 118 within the manifold are open between the contents of the can and the gun 28.

In FIG. 5, the manner of attachment between the bosses 82, 84 and the skirts 86, 88 is shown. Here, the extensions 122, 124 on the bosses 82, 84 may be seen entering the passages 126, 128 of the center portion of the manifold 50. The passages 126, 128 intersect the outlets 130, 132 which fit within dispenser passages 134, 136 in the dispenser body 60. As shown, plural O-rings 135 are provided on the adapter outlet ends 122, 124 and outside the outlet passages 130, 132.

In use, the operation of the device is relatively simple. The center section 51 of the manifold assembly 50 is placed in position of use between the two adapters 46, 48. The octagonal or other non-circular formations that form a shoulder in the adapters are pressed into place within the octagonal recesses of the can holder 100, achieving a snug fit therein. After the unit is preassembled, the gun 28 is attached to the outlet portion of the manifold, being secured (if necessary) thereto by a screw (not shown) extending through the passage 78. This secures the handle in the desired position.

The three-piece manifold and the gun handle being secured together, the unit is ready for insertion of the cans. A further tightening of the fit between these parts is assured by then inserting the cans 24, 26 and screwing them into the adapters until they are fully seated, thus capturing the can holder securely between the adapters and the cans, as shown in FIG. 5.

Figure 6:
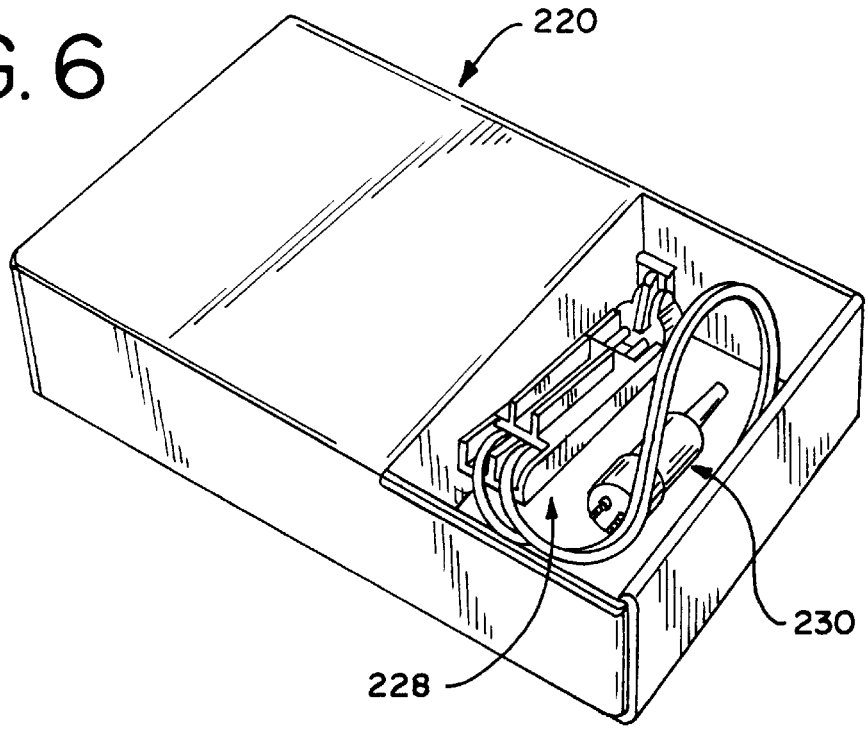
FIG. 6 is a perspective view of an alternate form of the invention, including the dispenser in a partially closed box.
Figure 7:
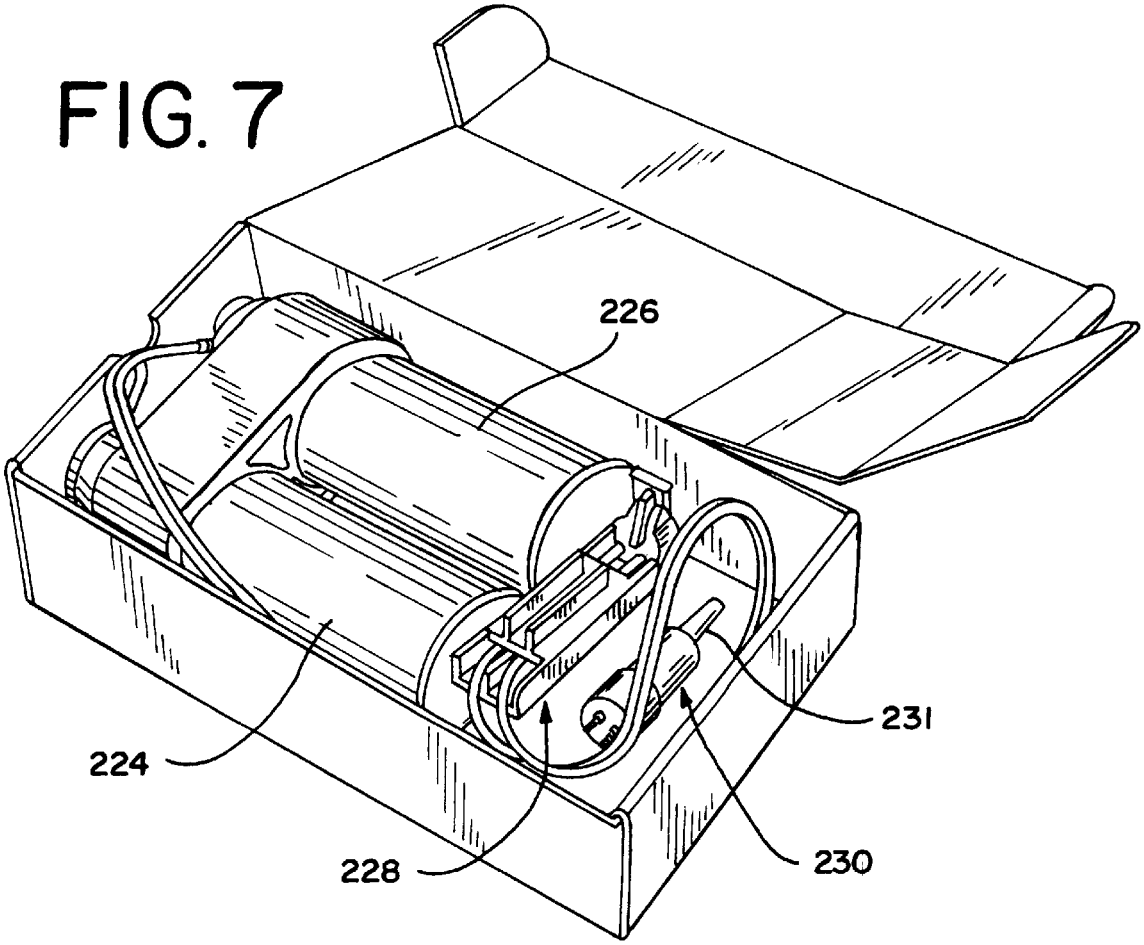
FIG. 7 is a view similar to that of FIG. 6, showing the cans and the adapters in their position of use, and showing the nozzle detached from the dispenser gun.
Figure 8:
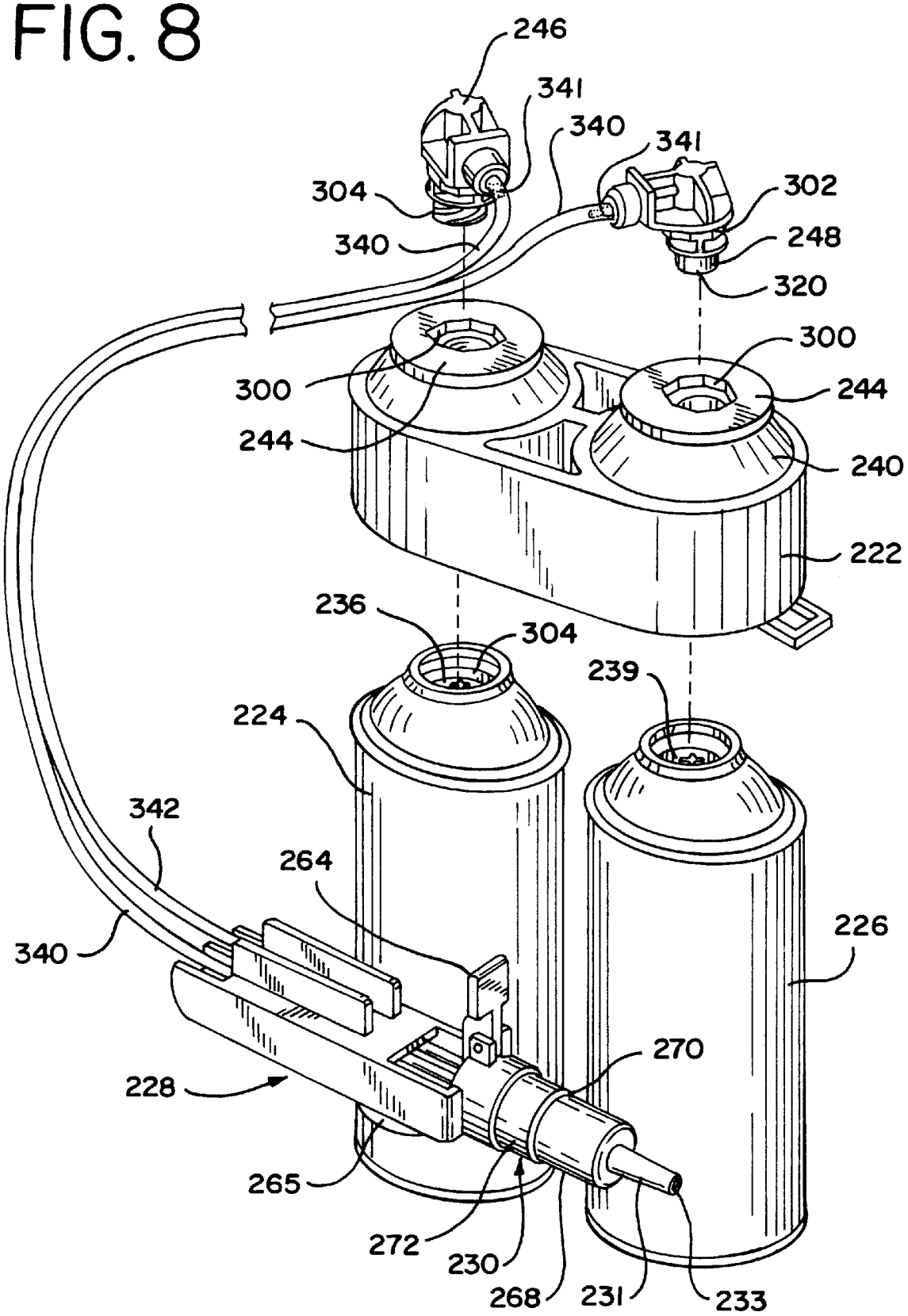
FIG. 8 is an exploded perspective view of the gun of FIGS. 6 and 7, showing the can holder, adapters and hoses separate from the can receivers and showing the dispenser in a position of use.

Referring now to FIGS. 6–8, another embodiment 220 of the invention is shown. Here, the containers 224, 226, the crowns 240, and the flat surface 244 on the crown 240 are the same as the earlier embodiments. The cans 224 and 226 contain, respectively, male and female threads. One can 224 contains a threaded valve cup 236 which is suitable for engagement with the adapter 246 by reason of its having exterior threads 304. The other can 226 is equipped with external threads (not shown) on the body of the valve 239 which engages the internal threads 320 on the adapter 248.

The adapters, however, instead of having their outlets in a facing position or arrangement, are placed at an angle to each other. Thus, the octagon formations 302 on each adapter fit within the openings 300 in the can holder 222. In this position, the adapters 246, 248 cannot move, especially with the cans clinched in place.

The hoses 340, 342 serve to connect the adapter 246, 248 to the dispenser generally designated 228, and the nozzle 230. This dispenser includes a nozzle generally designated 230 having a reduced diameter end 231 terminating in an outlet 233, and having major and minor diameter portions 268, 272 with an intermediate shoulder 270.

The ejector unit 264 and the knob 265 which controls the flow through both hoses 340, 342 are the same as those shown in U.S. Pat. No. 5,344,051. The knob 265 uses an eccentric wheel or snail cam, which, as the cam is rotated, shuts off or opens the flow of materials from the cans 224, 226. In operation, the gun is the same as that described in U.S. Pat. No. 5,344,051. After the nozzle is placed in the gun and the operating knob 265 is shut off, the cans are loaded in their respective adapters and tightened securely. This inherently opens the valves and renders the dispenser ready for use.

In the embodiment of FIGS. 6–8, because of the permeability of the hoses in comparison to that of the manifold, the unit is not as adaptable as the form shown in FIGS. 1–5 for long-term storage of the components. In some cases, an exposure of one to three days is the approximate maximum that may be achieved. Nevertheless, both the first and second embodiments of the dispenser are believed to represent, for the first time, a dispenser unit that can use containers of differing lengths or sizes, and can be refilled any number of times, with what is essentially a disposable dispenser. In the past, the guns or dispensers were of the type that were very rudimentary, and in some cases, not all that satisfactory, whereas in other cases, in order to obtain reusability, the units were unduly expensive. In the present concept, a comparatively inexpensive gun may be made, and yet the gun may be used a few or even a great number of times, merely by inserting cans over and over.

By reason of having the feature that prevents accidental insertion of the "wrong" can into the dispenser or gun, a significant advantage is achieved. This can be done by either using the more advantageous method of the internal/external threads or in a less desirable but still functional alternative, left- and right-hand threads. Other expedients will occur to those skilled in the art.

It will thus be seen that the present invention provides several new and improved dispensing systems, each having a number of advantages and characteristics pointed out and others which are inherent in the invention. It is anticipated that modifications and variations to the invention will occur to those skilled in the art and it is anticipated that such modifications and changes may be made to the described form of the invention without departing from the spirit of the invention, or the scope of the appended claims.

I claim:

1. In combination, a chemical product dispenser and a manifold attached thereto, said manifold including two separate passages for directing the contents of said containers to said dispenser through dispensing valves, two adapters forming a part of said manifold and having mutually engaging means for attachment to containers holding the ingredients of chemicals to be mixed by said dispenser, said adapters each having a different structural configuration for receiving and retaining said containers in snugly engaged relation, said adapters including valve actuators that operate said valves on said containers when said containers are snugly engaged with said adapters, whereby a container of the type intended to be attached to the first adapter is not suited for attachment to the second adapter, and a container intended to be secured to the second container cannot be attached to the first adapter.

2. A combination as defined in claim 1, wherein said dispenser is in the form of a gun.

3. A combination as defined in claim 1, in which said adapters are affixed in use to a holder for the containers.

4. A combination as defined in claim 3, said holder comprising a skirt portion, a dome portion and a substantially flat top portion in which said adapters are received, said holder also including a formation for reception of the chime of said cans, whereby the can valves, when tightened, are fully opened.

5. A combination as defined in claim 3, wherein said can holder includes two non-circular openings and said adapters each include a counterpart non-circular formation adapted to be received within said openings.

6. A combination as defined in claim 5, wherein said openings and said formations are polygonal in shape.

7. A combination as defined in claim 1, in which said arrangement further includes a fastener for affixing said dispenser to said manifold.

8. A combination as defined in claim 1, wherein said containers are cans.

9. A combination as defined in claim 1, wherein said containers are of different lengths.

10. A combination as defined in claim 1, wherein said containers intended to be attached to one of said adapters include a plurality of threads formed in the valve cup of the can.

11. A combination as defined in claim 1, wherein said containers intended to be attached to one of said adapters include a plurality of threads formed on the body of the dispensing valve within the container.

12. A combination as defined in claim 1, wherein said adapters and the containers with which they are associated in use include right- and left-hand threads, respectively.

13. A combination as defined in claim 1, wherein said manifold and said adapters are formed in separate parts, each of said adapters having a formation including a snout portion containing an O-ring for sealing purposes, said manifold center section including a pair of skirt portions for surrounding said formations on said adapters, said center section also including a pair of substantially identical projections, each being adapted to be received within formations defining inlet passages on said dispenser unit.

14. In combination, a dispenser, plural hoses supplying said dispenser with at least two separate components, said hoses being attached to adapters, said adapters being received within a single can holder unit, said adapters being separately configured so as to have one of said adapters equipped with a formation intended to engage counterpart formations on a first container having a first chemical component, and the other of said adapters include a formation adapted to engage a counterpart formation on the second container carrying a second chemical component, said first and second pairs of formations being constructed and arranged so that the first formation will not engage the second formation, and vice versa.

15. A combination as defined in claim 14, wherein said dispenser includes a disposable nozzle and a thumbwheel actuating the dispensing valve.

16. A combination as defined in claim 14, which includes means for preventing rotation of said adapters during insertion and tightening of the containers therein.

17. A combination as defined in claim 14, wherein said means include non-circular openings in the can holder and counterpart non-circular formations on said adapters.

18. A combination as defined in claim 14, wherein said non-circular openings and said surfaces on said adapter comprise congruent polygonal surfaces.

* * * * *